United States Patent [19]

Savard et al.

[11] 4,311,518

[45] Jan. 19, 1982

[54] HOMOGENIZATION OF METAL USING GAS

[75] Inventors: Guy Savard, Westmount; Robert G. H. Lee, Montreal, both of Canada

[73] Assignee: Canadian Liquid Air Ltd./Air Liquide Canada Ltee, Montreal, Canada

[21] Appl. No.: 197,514

[22] Filed: Oct. 16, 1980

[30] Foreign Application Priority Data

Oct. 31, 1979 [CA] Canada ..... 338904

[51] Int. Cl.[3] ..... C21C 5/34

[52] U.S. Cl. ..... 75/59; 75/60

[58] Field of Search ..... 75/59, 60

[56] References Cited

U.S. PATENT DOCUMENTS 2,855,293 10/1958 Savard ..... 75/60

*Primary Examiner*—P. D. Rosenberg

*Attorney, Agent, or Firm*—Bachman and LaPointe

[57] ABSTRACT

In the homogenization of molten metal with a gas, the gas is delivered to agitate the molten metal in a vessel, through an injector tube having a fine bore effective to prevent penetration of molten metal into and along the bore; when injection of gas is discontinued, molten metal is allowed to solidify on the tip of the tube to seal it; when gas is to be delivered to a second load of molten metal in the vessel, it is delivered, at least initially, at a pressure effective to unseal the tube at the tip to permit entry of the gas into the second load to agitate the molten metal and thereby homogenize it; the injector tube can be used for successive batches of molten metal without maintenance.

10 Claims, 7 Drawing Figures

HOMOGENIZATION OF METAL USING GAS

BACKGROUND OF THE INVENTION (a) Field of the Invention

This invention relates to the gaseous treatment of molten metal using gas; more specifically the invention relates to a method and apparatus for the homogenization or degasification of steel or other metals.

(b) Description of Prior Art

With the advent of continuous casting of steel and with the demands for improved quality of steels, the use of inert gas for stirring molten steel is increasing. Inert gas is used to homogenize the molten steel in terms of its chemical analysis and temperature in the ladle after tapping from the refining furnace, and before teeming the steel into ingots or into continuous casting machines. By such homogenization a steel can be obtained the properties of which are more uniform throughout.

Several methods are known for the homogenization of molten steel. In one method homogenization is carried by agitating the molten steel by stirring it with a steel ingot, in a ladle, the ingot being lowered by an overhead crane into the molten steel in the ladle. The movement of the crane results in movement of the ingot and stirring of the metal. This method is cumbersome, time consuming and not thorough.

Methods are known which involve stirring with gas and these are more reliable. The methods of gas stirring differ in the way the gas is introduced.

One such method employing gas is the hollow stopper rod technique, in which a ladle stopper rod made of steel is used. The rod is hollow so that gas may flow through it; and the stopper rod head has small holes radially disposed to permit gas outflow; the rod is protected by refractory sleeves. In operation the rod assembly, rather than being fixed to the ladle, is attached to a fixed elevated horizontal beam, the rod is placed with the head downwards and gas flows into the stopper rod from a gas inlet, at the top and out at the bottom, through holes in the rod head. A ladle containing molten metal is brought by a crane to a location underneath the rod assembly, and is raised so that the assembly is immersed in the molten metal and gas bubbles from the stopper rod head through the molten metal, producing the desired agitation.

This method is used commercially; however, such a stopper rod assembly only lasts from 5 to 10 treatments, after which it is replaced. Also the gas flow into the molten metal is not reliable since the refractory sleeves make a poor seal against the steel stopper rod. In view of this, the gas takes the path of least resistance between the steel rod and the refractory sleeves rather than into the molten metal. Finally, consistent stirring can only be ensured by observing the agitation at the surface of the molten metal and adjusting the gas flow until the desired degree of agitation is observed.

In another known method a porous refractory is used to introduce gases into molten metal; this method is practiced commercially. The method utilizes a refractory brick or porous plug which has the property of being permeable to gas under pressure, but substantially impervious to molten metal. The porous plug is provided as part of the ladle lining at a location where it is submerged when the ladle is filled with molten metal. The gas is introduced into the molten metal through the porous plug, the desired degree of stirring being achieved by altering the gas flow rate into the porous plug. Depending on local conditions, such porous plugs can have a life expectancy of 10 to 25 cycles. With molten cast iron analysis, the life can be 50 to 200 heats.

Yet another method employs a metal tube technique; this method is used in some plants. A steel tube is immersed into the refractory lining of a ladle, for example at or near the bottom, leading through the outside steel shell and refractory lining and terminating on the inside surface of the refractory. The flow of gas is started before the metal is tapped into the ladle. After the desired agitation, the flow of gas is stopped and the metal flows back into the tube and freezes. As a rule, the tube must be replaced after each cycle. Sometimes the used tube can be cleared by prodding with a steel bar or by drilling out the frozen metal. The tube can be reused until it becomes too short.

A modification of the metal tube technique is employed in U.S. Pat. No. 3,395,910—Ronald L. W. Holmes—issued Aug. 6, 1968; in this modification a metal tube is used having a nozzle; the tube passes through the casing and refractory lining of the ladle and the tube and nozzle are encased with a sheath of low grade refractory cement which in turn is surrounded by a sheath of high grade refractory brick; the refractory cement is molded around the nozzles so as to provide a discharge passage extending axially from the discharge end of the nozzle. The overall sheath thus prevents contact between the molten metal and the metal tube; the tube further includes a highly conductive stopper rod member at its inlet so that molten metal freezes there without entering the gas supply lines, in the event of a sudden loss of gas pressure causing the molten metal to enter the metal tube. The refractory sheath is designed to be replaced after every heat.

The porous refractory and metallic tube techniques to introduce a relatively non-reactive gas into the bottom of a molten metal bath is being practiced in some LD oxygen steelmaking converters to equilibrate the molten metal and slag.

In electric furnaces reverberatory furnaces and the like, these gas dispensing devices can also be used to stir the molten metal.

SUMMARY OF THE INVENTION

The invention provides a method and apparatus for the introduction of gas under pressure into molten metal, utilizing a metal injector tube having a fine bore which can be used in successive heats without maintenance.

The method and apparatus can be employed for the gas stirring of molten metal to homogenize it.

The method and apparatus can further be employed to flush out completely or partially, particular gas dissolved in molten metal.

The method and apparatus can also be employed to introduce a reactive gas, for example a reducing gas or an oxidizing gas into the molten metal, or to introduce into the molten metal a gas which is desired therein.

According to the invention, the internal diameter and wall thickness of the metal tube are selected such that molten metal freezes on the exposed end of the tube and seals the tip completely and entry of molten metal into the bore of the metal tube is prevented. The sealed tip is easily unsealed when the metal tube is used, by gas pressure.

The metal tube of the invention thus overcomes the disadvantages of the metal tubes used in the prior method referred to above and the modification of U.S. Pat. No. 3,395,910 in that it has a long life and can be used in successive heats without maintenance; this is in contrast with the prior metal tubes of larger diameter which require replacement after each use, and the modification of U.S. Pat. No. 3,395,910 wherein the refractory sleeve is replaced after each use. Further, there is no necessity for a stopper rod assembly such as disclosed in the U.S. patent to prevent entry of molten metal into the gas supply system, since the metal tube itself prevents this.

According to the invention there is provided a method of treating molten metal with a gas comprising (a) providing a vessel for molten metal, including an outer casing having a refractory lining and a metal injector tube passing through said casing and terminating at a tip at an inwardly facing surface of said refractory lining; said injector tube being adapted to deliver gas under pressure to molten metal in said vessel, and having a fine bore of a diameter effective to prevent penetration of molten metal into and along said bore, (b) introducing a first load of molten metal into said vessel, (c) delivering gas through said injector tube and into said molten metal at a pressure effective to agitate and homogenize said molten metal, (d) discontinuing the delivery of said gas and allowing molten metal to solidify on the tip of said tube to seal it, (e) removing homogenized molten metal from said vessel, (f) introducing a second load of molten metal into said vessel, (g) delivering gas through said injector tube at a pressure effective to unseal the tube at the tip, permitting entry of said gas into said second load, and (h) agitating said second load of molten metal with said gas to homogenize it.

According to another aspect of the invention there is provided a vessel for holding molten metal for treatment with gas under pressure comprising an outer casing lined with a refractory lining having an inwardly facing surface defining a cavity for molten metal, and a metal injector tube passing through said casing and terminating at said inwardly facing surface; said injector tube being adapted to deliver a stream of gas, under pressure, to said cavity; said injector tube having a fine bore of a diameter effective to prevent penetration of molten metal from said cavity into and along said bore.

The injector tube has a fine bore, the maximum diameter of which is determined by the requirement that molten metal should not enter the bore. The maximum diameter can be determined for particular molten metals by experiment. In the case of ferrous metals such as iron and steel the maximum permissible bore diameter is about 2.5 mm. The minimum diameter permissible is determined by the requirement that the injector tube function to deliver inert gas at a reasonable rate and pressure to homogenize the molten metal. The thickness of the wall of the injector tube is determined by the requirement that the tube has adequate strength for normal handling.

The injector tube may be made of any metal which will not collapse or soften under the working conditions; by way of example the injector tube may be fabricated of stainless steel, low carbon steel or copper. The process conditions may be varied depending on the nature of the metal used to fabricate the tube.

In operation the injector tube is placed in a refractory-lined vessel, for example a ladle, so that the gas exit end or tip of the tube terminates at the inwardly facing surface of the refractory lining; the injector tube should not project beyond the refractory lining in view of the high temperatures to which it would be submitted. Molten metal, for example, molten steel, is tapped into the ladle, the injector tube becomes sealed with metal, which solidifies on the exposed tip. As the temperature of the injector tube increases, the tube becomes extremely weak physically. When gas agitation is needed, gas pressure is applied to the tube to unseal it. The unsealing may occur either by blowing-off the solidified metal on the tip or the hot (weak) part of the tube near the tip, where it approaches the temperature of molten metal. This results in the gas pressure clearing the tube of solidified metal thus allowing the gas to flow through the tube. After achieving the desired agitation of the molten metal, the gas flow is stopped, and molten metal again seals the tip of the tube by solidifying onto the tip.

On the next cycle, the hot molten metal tapped into the ladle will heat up the injector tube and the seal of metal on the tip so that the seal is blown off or the tube bursts as described above, thus permitting the full flow of agitating gas to enter the ladle.

Whether the unsealing occurs by blowing-off the solidified metal, sealing off the tip of the tube, or by bursting the tube will depend on the nature of the metal from which the tube is fabricated. In the case of a stainless steel injector tube used for treatment of molten steel, the solidified metal sealing the tip is more likely to be blown-off by the gas pressure, since stainless steel is relatively strong at high temperatures. In the case of a copper injector tube used for treatment of molten steel it is more likely that the tube itself will burst at the tip, copper being a weaker metal, especially at high temperatures.

Copper and low carbon steel tubes have the advantage that a lower gas pressure is needed to unseal them as compared with stainless steel tubes.

It will be appreciated that with continued use, there may be some erosion of the injector tube at the tip; however, it is found that this is small and the tube remains intact even after prolonged use. The life of the injectors should be the same as the refractory lining.

Contrasted to an expensive porous plug, a costly reline of the hollow stopper rod, replacing or cleaning a large diameter steel tube after each heat, or replacing a refractory sleeve such as that in U.S. Pat. No. 3,395,910, an injector tube based on this invention, will last for many heats.

BRIEF DESCRIPTION OF THE DRAWINGS

The invention has been generally described and will now be illustrated in more detail by reference to the accompanying drawings, illustrating preferred embodiments and in which.

DESCRIPTION OF PREFERRED EMBODIMENTS

Figure 2:
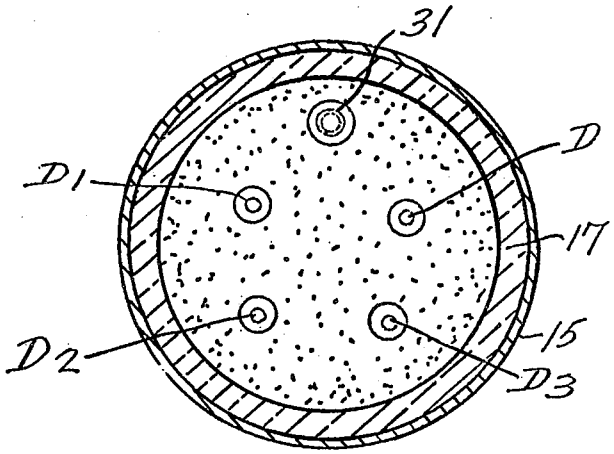
FIG. 2 is a horizontal cross section as along the line 2—2 of FIG. 1 of a ladle equipped with several injector tubes.

In the drawings, a ladle is shown generally as B. The adle B has a steel shell 15 and a refractory lining 17 and ontains a bath C of molten metal. The bottom of the adle B is equipped with a refractory member 19 hrough which projects injector tube D for injecting nert gas into bath C. The ladle B is provided with a over 21 lined with refractory 23.

The cover 21 protects the agitated surface of the nolten metal bath C from moisture and oxygen in the ambient atmosphere. For increased effectiveness of this protection, it may be desirable to flow additional inert gas through the cover 21. For this purpose, an entrance pipe (not shown) is provided. The cover 21 also reduces heat loss by radiation. For example, in one plant, treating 60 ton steel heats with argon gas, the rate of temperature drop was reduced from about 12° F./min., without cover 21, to about 7° F./min. with a cover 21.

With further reference to FIG. 2, there is shown a adle B equipped with four injector tubes D, $D_1$, $D_2$, $D_3$, and a teeming nozzle 31.

By dividing the flow of gas between several sources, as shown in FIG. 2, it is possible to use, in total, a much higher gas flow rate without excessive splashing of the metal.

The nature of the injector tube D and its use in the present invention will be described in more detail. The bore diameter of the injector tube D should not be more than about 2.5 mm when the bath C is molten ferrous metal. A diameter greater than this can permit "weeping", wherein molten metal drips back into the tube, causing internal blockages, which cannot be cleared away by gas pressure alone. Such blockages result in having to clear the tube D mechanically or to replace it between use. The permissible inside diameter, within the 2.5 mm maximum limitation, is determined by gas flow rate and flushing gas pressure. A minimum practical inside diameter is about 1/32 inch.

The wall thickness of the tube D should be between 0.01 inches to 5/32 inches. The minimum wall thickness is controlled by the mechanical strength needed of the tube. The maximum wall thickness is determined by the combination of temperature of the molten metal with which it comes into contact, gas pressure and type of refractory surrounding it. Heat transfer, under the conditions existing at the zone around the injector D, refractory and molten metal contact is extremely complex. So optimum dimensions have to be determined by experimentation.

The injector tube D may be a single tube as shown in FIG. 3. If a higher flow is necessary to obtain the desired agitation in the molten metal, several tubes can be used.

Figures 3A, 3B, 4:
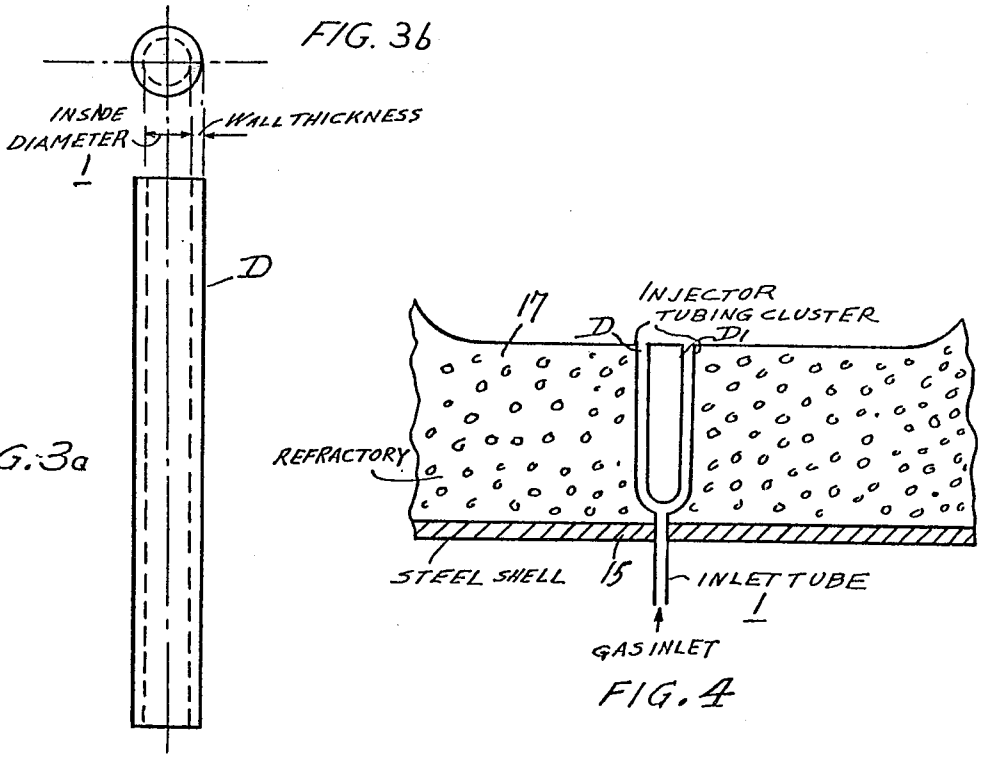
FIGS. 3*a* and 3*b* are side and end views respectively of an injector tube suitable for use in the invention.
FIG. 4 is a fragmentary vertical cross section through a ladle showing an injector tube cluster.

Another way to provide for a higher gas flow rate is to cluster the injector tubes. In each cluster, two or more injector tubes are used, connected to a common inlet into the ladle; FIG. 4 illustrates this clustering. With further reference to FIG. 4, a common inlet tube 1 leads to a cluster of injector tubes D, $D_1$, through a steel shell 15 and refractory lining 17. This permits the flow of gas, under any condition, to be multiplied while still maintaining the individual injector tubes within the effective dimensional tolerances.

To achieve still greater flow, multiple clusters of injector tubes may be suitably arranged for efficient operation.

The number of injector tubes D employed is dependent on a number of factors and can be used to overcome some inherent disadvantages of using only one source of flushing gas.

In most steel plants, the ladle is of a size to hold a full batch of steel from the refining furnace. The subdivision of the gas utilizing a cluster of injector tubes, as described, permits the agitation and homogenization of a full batch, whereas gas from a single source could produce splashing, which could then only be avoided by reducing the amount of metal in the ladle thereby increasing the head space to allow for splashing. Of course, the conditions for splashing in a LD converter, electric furnace and a reverberatory are more liberal than in a ladle.

Figure 5:
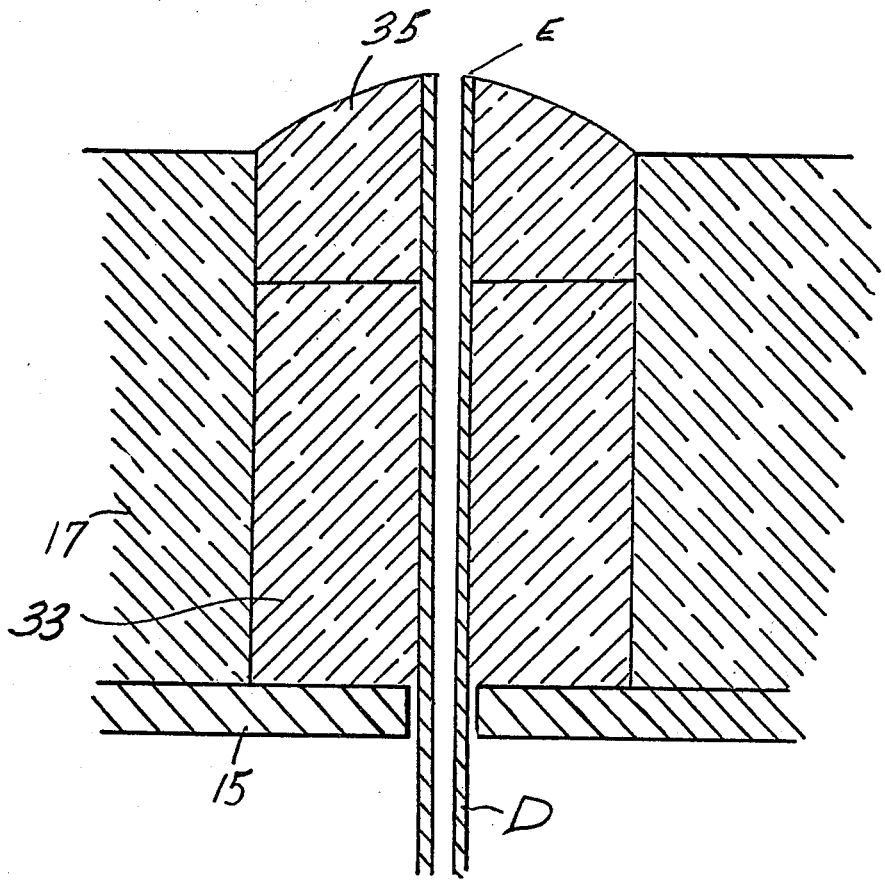
FIG. 5 is a greatly enlarged fragmentary cross section showing an injection zone of a vessel bottom for containing molten metal.

FIG. 5 is an enlarged view of an injector tube D through steel shell 15 and the refractory lining 17. The injector tube D is surrounded by refractory parts 33 and 35, which may be prefabricated bricks with rammed refractory material or a slurry of refractory; the refractory parts 33 and 35 form a part of the refractory lining 17; the tip E of the injector tube D does not extend beyond the exposed inner surface of the refractory part 35.

To simplify removal and replacement of the injector tubes, their tips can be modified to accommodate a material weaker than the adjacent refractory, for example, graphite, which can shatter or break up during removal of the used injector tube.

Figure 7:
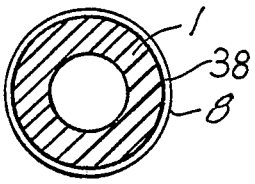
FIG. 7 is a transverse cross section of the tube of 'IG. 6 taken along the line 7—7.
Figure 6:
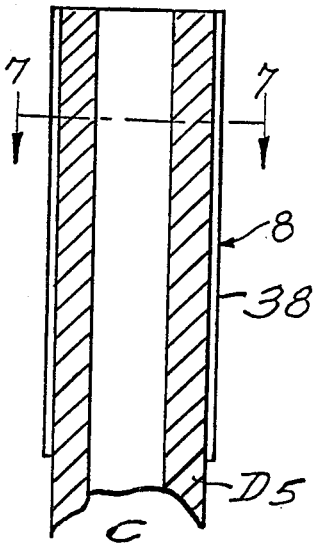
FIG. 6 is a longitudinal cross section through an lternative type of injector tube according to the inven- ion. The injector tubing 38 is encased in a thin metallic leeve 8.

FIGS. 6 and 7 show such an injector tube $D_5$ with a thin sleeve 8.

While the invention has been described in terms of inert, or relatively inert, gases, it is not necessarily restricted to the use of such gases, but can be used with reducing gases, for example, natural gas, propane, etc. Liquid hydrocarbons can also be used. Active oxidizing gases, for example, oxygen, can be used through the injector, not in commercially pure form, but diluted with an inert gas, for example, argon, helium, nitrogen, etc. The oxygen could be present up to about 75% by volume.

In a particular embodiment the gas contains, by volume, 70% molecular oxygen.

The molten metal processed via this invention can be subjected to lower or higher than atmospheric pressure depending on the results desired.

The gas pressure to unseal the sealed tip of the injector tube may suitably be from about 30 to about 600 psig, although higher pressures may be employed. When the injector tube is unsealed, as is the case initially, and after the unsealing, the gas pressure may be lowered as desired and is essentially dictated by the desire to agitate the molten metal to homogenize it.

The invention will be still further illustrated by reference to the following Example.

Figure 1:
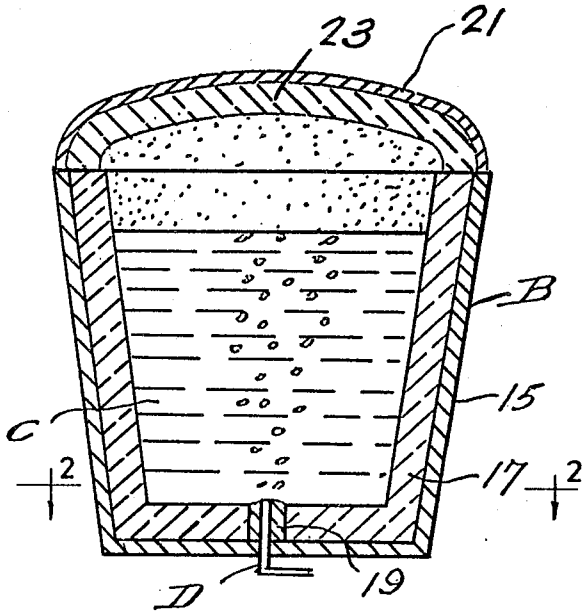
FIG. 1 is a vertical cross section through a ladle, containing a bath of metal and equipped with an injector tube according to the invention. However this container can be LD type converter, electric furnace or a reverberatory.

There was employed a mild steel injector tube having an outer diameter of 0.125 inches, a wall thickness of 0.032 inches and a bore diameter 0.061 inches, embedded into the refractory lining at the bottom of a ladle B as shown in FIG. 1; 250 pounds of molten iron were poured into the ladle B; and metal solidified on the exposed tip of the tube; sealing the tube. Argon was applied at 225 psig and the seal on the tube was blown clear and argon agitation was achieved. The gas was stopped and the tip of the tube was again sealed by the molten metal. The molten metal was then teemed. On the next cycle, 250 pounds of molten metal was tapped into the ladle B. Argon gas pressure was applied and the normal gas flow was achieved. The cycle may be applied again and again. The effective life span of the tube is a function of the ladle refractory campaign.

We claim:

1. A method of treating molten metal with a gas comprising (a) providing a vessel for molten metal, said vessel including a casing having a refractory lining and a metal injector tube passing through said casing and terminating at a tip at an inwardly facing surface of said refractory lining; said injector tube delivering inert gas under pressure to molten metal in said vessel, and having a fine bore of a diameter effective to prevent penetration of molten metal into and along said bore, (b) introducing a first load of untreated molten metal into said vessel, (c) delivering inert gas through said injector tube and into said molten metal at a pressure effective to agitate and homogenize said molten metal, (d) discontinuing the delivery of said inert gas and allowing molten metal to solidify on the tip of said tube to seal it, (e) removing homogenized molten metal from said vessel, (f) introducing a second load of untreated molten metal into said vessel, (g) delivering inert gas through said injector tube at a pressure effective to unseal the tube at the tip, permitting entry of said inert gas into said second load, and (h) agitating said second load of molten metal with said inert gas to homogenize it.

2. A method according to claim 1 wherein molten metal from said first load in (b) is allowed to solidify on the tip sealing said tube, said gas delivered in (c) being effective to unseal the tube.

3. A method according to claim 1, wherein said molten metal is ferrous metal.

4. A method according to claim 1 wherein said molten metal contains a dissolved gas which is at least partially flushed out of said molten metal with said gas delivered under pressure through said injector tube.

5. A method according to claim 1, wherein said bore has a diameter not greater than 2.5 mm.

6. A method according to claim 1, wherein said inner material of the injector tubing is fragile and outer sleeve provides the strength.

7. A method according to claim 1, wherein said ferrous metal is being refined with oxygen introduced with oxygen from the top of the molten metal bath.

8. A method according to claim 1, wherein said gas contains, by volume, 70% molecular oxygen.

9. A method of treating a molten metal composition with a reducing gas comprising:

(a) providing a vessel for a molten metal composition, said vessel including a casing having a refractory lining and a metal injector tube passing through said casing and terminating at a tip at an inwardly facing surface of said refractory refractory lining; said injector tube delivering a reducing gas under pressure to a molten metal composition in said vessel, and having a fine bore diameter effective to prevent penetration of molten metal into and along said bore, (b) introducing a first load of untreated metal composition into said vessel, (c) delivering reducing gas through said injector tube and into said molten metal composition, (d) discontinuing the delivery of said reducing gas and allowing molten metal to solidify on the tip of said tube to seal it, (e) removing treated molten metal from said vessel, (f) introducing a second load of untreated molten metal composition into said vessel, (g) delivering reducing gas through said injector tube at a pressure effective to unseal the tube at the tip, permitting entry of said reducing gas into said second load, and (h) treating said second load of molten metal composition with said reducing gas.

10. A method of treating a molten metal composition with an oxidizing gas, comprising:

(a) providing a vessel for a molten metal composition, said vessel including a casing having a refractory lining and a metal injector tube passing through said casing and terminating at a tip at an inwardly facing surface of said refractory lining; said injector tube delivering an oxidizing gas containing up to about 75% oxygen, by volume, under pressure, to the composition in the vessel, and having a fine bore of a diameter effective to prevent penetration of molten metal into and along said bore, (b) introducing a first load of untreated molten metal composition into said vessel, (c) delivering oxidizing gas containing up to about 75% by volume, oxygen, at low pressure through said injector tube and into said composition, (d) discontinuing the delivery of said oxidizing gas and allowing molten metal to solidify on the tip of said tube to seal it, (e) removing treated molten metal from said vessel, (f) introducing a second load of untreated molten metal composition into said vessel, (g) delivering oxidizing gas containing up to about 75%, by volume, oxygen at a pressure effective to unseal the tube at the tip, permitting entry of said oxidizing gas into said second load, and (h) continuing delivery of said oxidizing gas at low pressure to treat said second load.

* * * * *

UNITED STATES PATENT AND TRADEMARK OFFICE

CERTIFICATE OF CORRECTION

PATENT NO. : 4,311,518

DATED : January 19, 1982

INVENTOR(S) : Guy Savard and Robert G.H. Lee

It is certified that error appears in the above-identified patent and that said Letters Patent are hereby corrected as shown below:

Column 8, claim 8, line 1, change the dependency from "1" to --10--.

Column 8, claim 9, line 9, delete "refractory", second occurrence.

Signed and Sealed this

*Eleventh* Day of *May 1982*

[SEAL]

*Attest:*

GERALD J. MOSSINGHOFF

*Attesting Officer* *Commissioner of Patents and Trademarks*